US006065808A

United States Patent [19]

Tinsley

[11] Patent Number: 6,065,808

[45] Date of Patent: May 23, 2000

[54] MASSAGE CHAIR

[76] Inventor: Ronald E. Tinsley, 2944 Adams St., Eugene, Oreg. 97478

[21] Appl. No.: 09/199,934

[22] Filed: Nov. 25, 1998

[51] Int. Cl.[7] ..... A47C 1/02

[52] U.S. Cl. ..... 297/432.11; 297/195.11

[58] Field of Search ..... 297/195.11, 423.11, 297/423.12; 5/620, 622, 623, 638

[56] References Cited

U.S. PATENT DOCUMENTS

| | | | |
|---|---|---|---|
| D. 369,691 | 5/1996 | Haynes . | |
| 4,650,249 | 3/1987 | Serber | 297/423.11 X |
| 4,746,167 | 5/1988 | Palmer . | |
| 4,971,040 | 11/1990 | Gillotti . | |
| 5,401,078 | 3/1995 | Blach . | |
| 5,487,590 | 1/1996 | Haynes | 297/195.11 X |
| 5,762,402 | 6/1998 | Gillotti . | |

*Primary Examiner*—Peter R. Brown
*Attorney, Agent, or Firm*—Robert E. Howard

[57] ABSTRACT

An adjustable and portable massage chair. The massage chair includes a seat subassembly and an upper body support subassembly. The seat subassembly is comprised of a pair of front legs and a pair of rear legs, the rear legs being pivotally attached to the front legs. A seat is pivotally attached to the upper end of the pair of front legs and adjustably attached to the upper end of a seat support post. The lower end of the seat support post is pivotally attached to a lower portion of the rear legs. The upper body subassembly is comprised of a pair of support legs pivotally attached at their lower portion to a lower portion of the front legs of the seat subassembly. A chest support is pivotally attached to the upper portion of the support legs, and a face cradle is pivotally attached to the chest support. An arm support is located below the chest support and pivotally attached to a mid-portion of the support legs. A pair of connector arms extend between the support legs of the upper body support subassembly and the front legs of the seat subassembly. The connector arms are slidingly attached to the support legs and pivotally attached to the front legs to thereby permit the seat subassembly and the upper body support subassembly to be folded towards each other.

15 Claims, 3 Drawing Sheets

MASSAGE CHAIR

FIELD OF THE INVENTION

This invention relates to a massage chair. More particularly, it relates to a massage chair that is adjustable and portable.

BACKGROUND OF THE INVENTION

Body massaging is done for pleasure and for therapeutic reasons. Typically, obtaining a massage requires a visit to the offices of the person administering the massage. Clients are typically massaged while laying down on a specially configured massage table. Such massage tables are generally portable.

Massage chairs are also used for administering massages to clients. Clients typically sit in such massage chairs in a position facing the chair so that their back, shoulders, or neck are accessible to the person administering the massage. Some massage chairs are non-portable, and the client must visit the offices of the massage therapist. Most massage chairs are portable and may be taken to the client's home, office or other location by the therapist. Some massage chairs are both portable and adjustable.

Exemplary massage chairs are shown in U.S. Pat. Nos. 4,746,167; 4,971,040; 5,401,078; 5,762,402; and Design U.S. Pat. No. 369,691.

It is an object of the present invention to provide a simple massage chair that is both portable and adjustable.

DESCRIPTION OF THE PREFERRED EMBODIMENT

Figure 1:
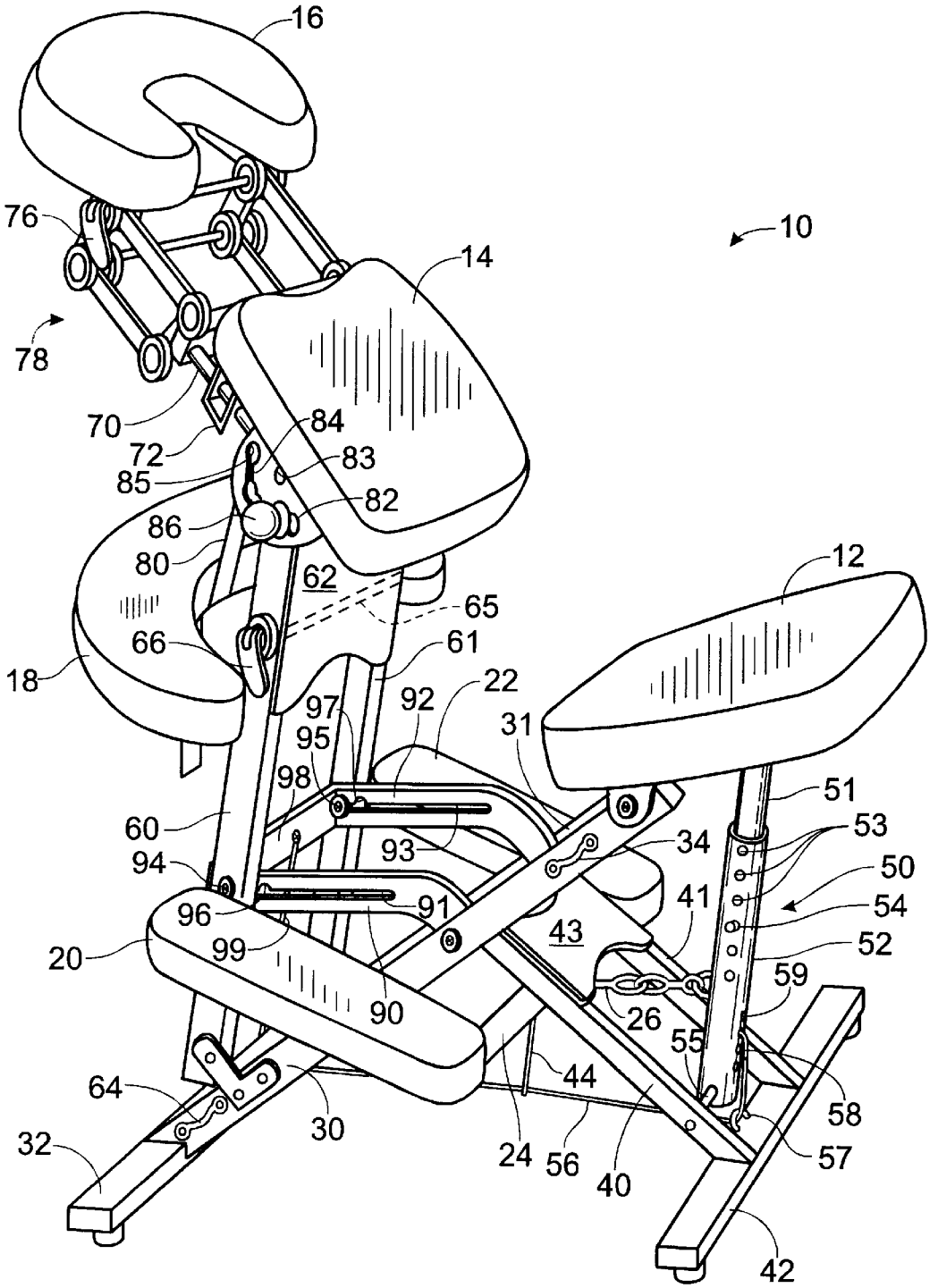
FIG. 1 is a perspective view of the massage chair of the present invention, shown in its unfolded position.

Massage chair 10 accommodates a person (not shown) who would sit in the chair with their buttocks on seat 12, their chest on chest support 14, their face against face cradle 16, their forearms resting on arm support 18, and their knees and lower legs resting on left and right leg supports 20 and 22.

Herein, whenever directional terms are used, they will be used with reference to the position occupied by a person sitting in chair 10. Thus, the terms "right" and "left" refer to what would be the right and left side of a person sitting in the chair 10; the terms "front" and "back" refer to what would be the front and back of a person sitting in the chair 10; and the terms "upper" and "lower" refer to what would be the upper and lower parts of the body of a person sitting in chair 10.

The chair 10 may be described as being comprised of two subassemblies, a seat subassembly and an upper body support subassembly.

The seat subassembly is comprised of a pair of left and right front legs 30 and 31 that are fixedly attached at their lower ends to a first (front) foot member 32 and are pivotally attached at their upper ends to the bottom of seat 12.

The seat subassembly is further comprised of a pair of left and right rear legs 40 and 41 that are fixedly attached at their lower ends to a second (rear) foot member 42, and pivotally attached at their upper ends to a mid-portion of front legs 30 and 31. A cross brace 43 extends between, and is attached at its outer edges to, rear legs 40 and 41

An adjustable seat support means 50 is comprised of a male tubular member 51 and a female tubular member 52. Male member 51 is slidably seated inside female member 52. Female member 52 has a plurality of vertical adjustment holes 53 located therein and male member 51 has a spring loaded locking pin 54 extending through an adjacent adjustment hole 53 to prevent movement of female member 52 relative to male member 51. Pin 54 may be depressed to allow movement of male member 51 and female member 52 up and down relative to each other until the desired height of the rear portion of seat 12 is obtained. Upon the desired height being obtained, pin 54 is released to engage an adjacent adjustment hole 53 and lock female member 52 into place.

The upper end of male member 51 is pivotally attached to the middle to rear underside portion of seat 12, and the lower end of female member 52 is pivotally attached to cross pin 55 which extends between, and is connected to, rear legs 40 and 41 at their lower end.

A horizontally disposed first cable 56 is attached at its first end to first foot member 32 and extends between first and second foot members 42 and 42. First cable 56 passes through eye 57 located on rear foot 42, and is attached at its second end to hook member 58. Hook member 58 is adapted to be inserted into one of a plurality of horizontal adjustment holes 59 located at the lower end of female member 52. First cable 56 is used to adjust the horizontal distance between first and second foot members 32 and 42, and keeps them from spreading apart when an outward force is applied to them.

Vertically disposed cable 44 is attached at its lower end to the mid-portion of first cable 56 and at its upper end to the bottom of cross brace 24. Cable 44 is merely used to keep first cable 56 within the confines of chair 10 when it is folded up.

The upper body support subassembly is comprised of left and right upper body support legs 60 and 61 that are pivotally attached to a lower portion of front legs 30 and 31 of the seat subassembly. Support legs 60 and 61 are attached at an upper portion to cross brace 62 extending therebetween. A chest support 14 is pivotally attached to the upper portion of support legs 60 and 61.

Chest support 14 has identical left and right pivot ears 82 extending downwardly therefrom, only the left pivot ear 82 being shown. Pivot ears 82 are pivotally attached to the upper ends of support legs 60 and 61 by means of identical left and right pins 83 extending therethrough, only left pin 83 being shown.

Pivot ears 82 both have an arcuate slot 84 extending therethrough. Arcuate slot 84 has several enlarged locking holes 85 positioned along its length. A spring loaded rod (not shown) extends between knob 86 on the left side and support leg 61 on the right side, and has an enlarged head portion located on each end adapted to lockingly engage one of adjacent locking holes 85 when know 86 is urged outwardly by the rod spring. Thus, when knob 86 is pushed inwardly (toward support leg 61), the enlarged head portions on each end of the rod attached to knob 86 vacates the adjacent locking hole 85 with which it was lockingly engaged, and chest support 14 may be pivoted around left and right pivot pins 83 to a new position. Upon releasing knob 86, the spring loaded rod attached thereto is urged outwardly toward support leg 60, and the enlarged head portions thereof engage an adjacent locking hole 85.

Figure 2:
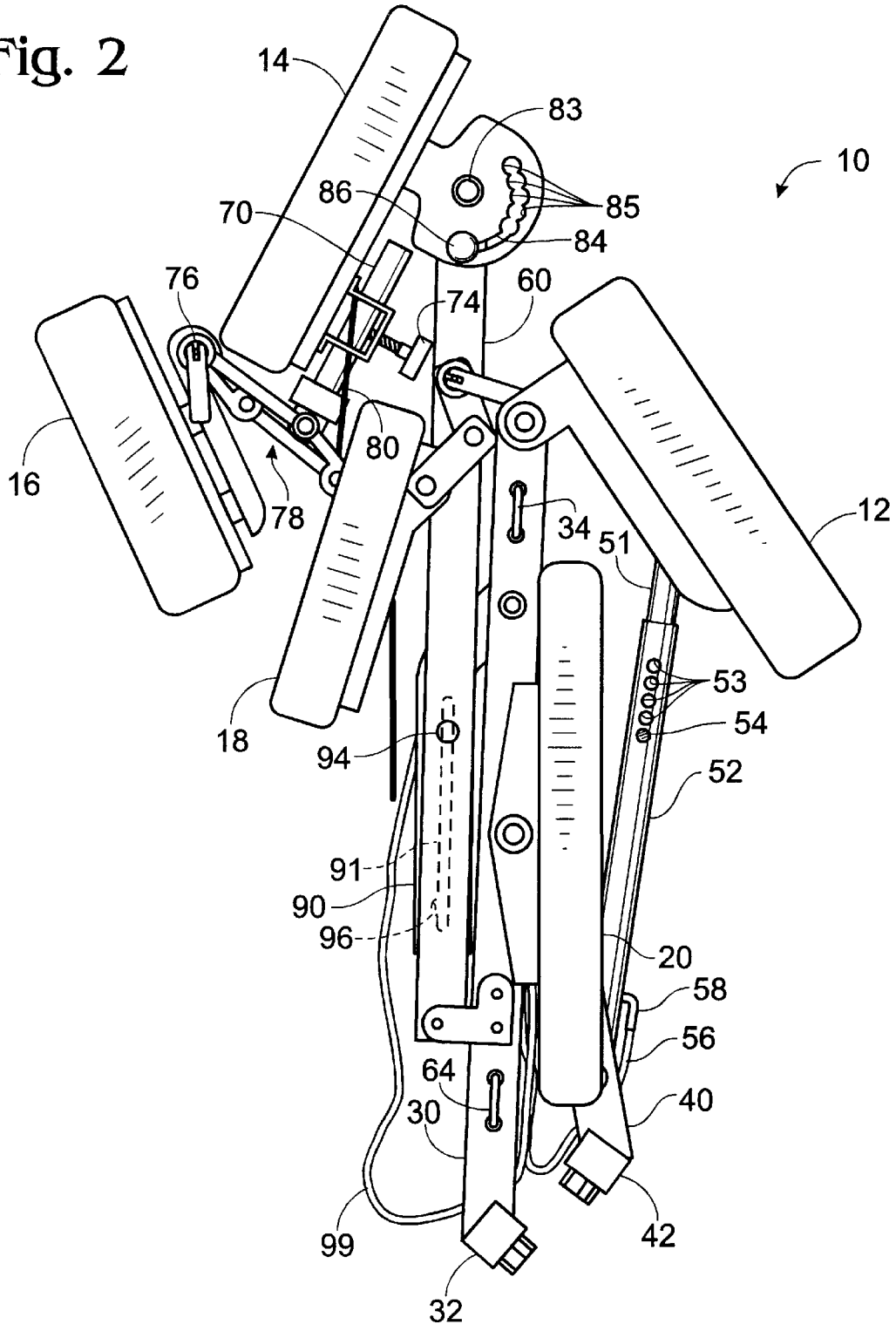
FIG. 2 is a side, elevation view of the massage chair of the present invention, shown in its folded position.

Face cradle 16 is pivotally attached to the outer ends of identical and parallel left and right support rods 70, only left support 70 being shown. Support rods 70 pass through openings in identical left and right rod holder blocks 72, only left block 72 being shown, and are held in place therein by identical left and right threaded bolts 74, only left bolt 74 being shown. Thus, head support 16 may be moved toward or away from chest support 14 by loosening left and right bolts 74, and moving right and left support rods 70 in or out of right and left blocks 72 until the desired spacing is obtained wherein left and right bolts 74 would again be tightened against support rods 70. Face cradle 16 may also be moved up and down by unlocking locking lever 76 and adjusting the position of head support 16 to a desired position about pivot rod 77 whereupon locking lever 76 can be lockingly engaged to prevent further movement. Parallelogram cantilever member 78 can be collapsed for storage or transportation, as shown in FIG. 2.

Arm rest 18 is pivotally attached at its rear end to support legs 60 and 61 by means of a cross rod 65 and locking lever 66. In the unfolded position shown in FIG. 1, arm rest 18 may be adjusted up or down by means of strap 80 which is fixed at one end to the underside of chest support 14 and adjustably attached to a strap buckle (not shown) located on the underside of arm rest 18.

Leg supports 20 and 22 are pivotally attached at a mid-portion to front legs 30 and 31 by a frame member located on the underside thereof (not shown), and are connected at their rear ends by cross brace 24. Cable 26 is connected at one end to the middle of cross brace 24 and is releasably attached at its other end to an eye extending from female member 52.

Support legs 60 and 61 are adjustably attached to front legs 30 and 31 by means of left and right slotted connector arms 90 and 92. Connector arm 90 has a longitudinal slot 91 therein and, similarly, connector arm 92 has a longitudinal slot 93 therein. Left and right slot pin members 94 and 95 are attached to left and right support legs 60 and 61, respectively, and slidingly engage slots 91 and 93, respectively. Slot 91 and 93 have enlarged openings 96 and 97 located at their front ends to receive slot pins 94 and 95 in locking engagement, as shown in FIG. 1. Cross brace member 98 extends between connectors arms 90 and 92, and is integral therewith. A tensioning cable 99 is attached at its upper end to cross brace member 98 and at its lower end to first foot member 32. Tensioning cable 99 is made of bungee cord, or similar construction, and, in the position of the chair 10 shown in FIG. 1, urges slot pins 94 and 95 into locking engagement with enlarged openings 96 and 97.

FIG. 2 shows massage chair 10 in its folded position, the position used for transporting the chair. A strap, not shown, may be hooked to strap handles 34 and 64 for ease of carrying.

Figure 4:
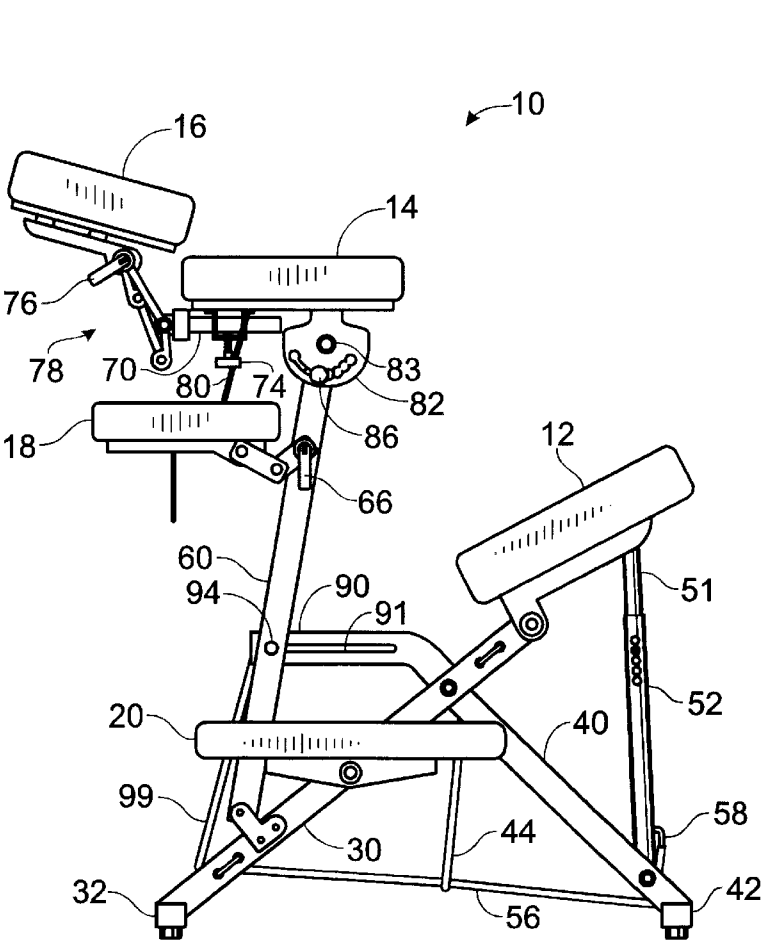
FIGS. 3 and 4 are side, elevation views of the massage chair of the invention in its unfolded position with various parts adjusted to different positions.
Figure 3:
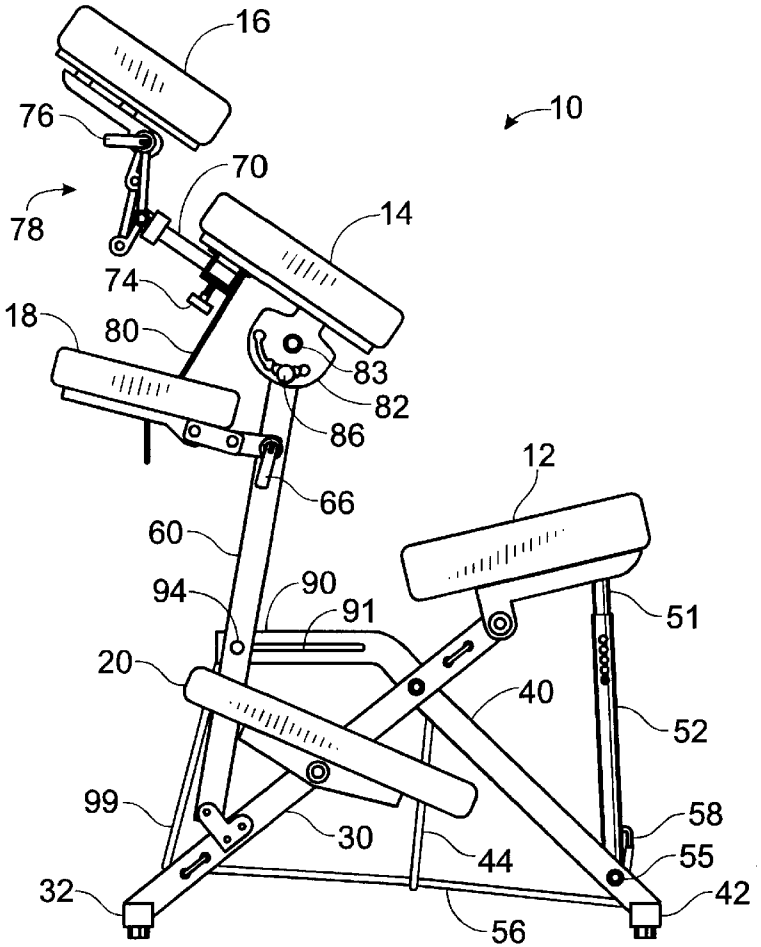

To fold chair 10 from the operable position shown in FIGS. 1, 3, and 4 to the transport or storage position shown in FIG. 2, the various parts are folded inwardly around their various pivot points. One way of folding chair 10 will be described.

First, face cradle 16 is pushed toward chest support 14 by first loosening left and right threaded bolts 74 so that left and right support rods 70 are free to slide inwardly through left and right blocks 72. Locking lever 76 would then be unlocked, and face cradle 16 pivoted downwardly relative to chest support 14 to the relative position shown in FIG. 2.

Chest support 14 would then be pivoted downwardly about pivot pins 83 by pushing inwardly on knob 86 to disengage the enlarged head portions of the pivot rod attached thereto from adjacent enlarged locking openings 85 in ear 82.

Once chest support 14 is pivoted downwardly, strap 80 no longer prevents arm support 18 from moving downwardly since it becomes slack, and arm support 18 can be pivoted downwardly about pivot rod 65 by unlocking locking lever 66.

Left and right leg supports 20 and 22 can next be pivoted upwardly by unhooking cable 26 from an eye located on female post member 52.

Seat 12 is then lowered by releasing locking pin 54 and permitting male post member 51 to slide into female post member 52.

Support legs 60 and 61 can then be folded toward the front legs 30 and 31 of seat subassembly by releasing left and right slot pins 94 and 95 from the enlarged, locking portions 96 and 97 of slots 91 and 93 located in connector arms 90 and 92, thereby permitting pins 94 and 95 to slide upwardly in slots 91 and 93 to the position shown in FIG. 2.

Finally, rear legs 40 and 41 are folded toward front legs 30 and 31 to complete the folding of chair 10 into the folded position shown in FIG. 2.

FIGS. 3 and 4 show various parts of chair 10 adjusted to different positions, such as would be done to accommodate clients of different sizes for seating in chair 10 preparatory to a massage.

Locking levers 66 can be any type of locking mechanism known in the art, such as a cam type locking lever, a threaded member, mating gears, etc.

Seat 12, chest support 14, face cradle 16, arm rest 18 and leg supports 20 and 22 can be, and preferably are, padded. Any of these padded supports may be removable from an underlying surface by use of Velcro.

Although a preferred embodiment has been described, modifications may be made thereto without departing from the scope of the invention claimed herein.

The invention claimed is:

1. An adjustable and portable massage chair comprising:

a seat subassembly comprising a pair of front and rear legs, said rear legs being pivotally attached at an upper portion to a mid-portion of said front legs, a vertically adjustable seat support means pivotally attached at its lower portion to said rear legs, a seat pivotally attached to an upper portion of said front legs and pivotally attached to an upper portion of said seat support means;

an upper body support subassembly comprising a pair of support legs pivotally attached at their lower portion to a lower portion of said front legs of said seat subassembly, a chest support pivotally attached to the upper portion of said support legs, a face cradle pivotally attached to said chest support, and an arm support pivotally attached to a mid-portion of said support legs; and a pair of connector arms pivotally attached at their first ends to said front legs of said seat subassembly, and attached at their second ends to said support legs by releasable locking means.

2. The chair of claim 1 additionally including a pair of leg support means pivotally attached at their mid-portion to said front legs of said seat subassembly.

3. The chair of claim 1 including a cross brace between said rear legs of said seat subassembly.

4. The chair of claim 1 including a cross brace between said support legs of said upper body support subassembly.

5. The chair of claim 1 including a cross brace between the second ends of said pair of connector arms.

6. The chair of claim 5 wherein said cross brace is integral with said connector arms.

7. The chair of claim 1 wherein said vertically adjustable seat support means is comprised of a male member pivotally attached to said seat and a female member pivotally attached to said rear legs, said male member being slidably located within said female member and adapted to lockingly engage said female member.

8. The chair of claim 1 wherein said face cradle has a pair of support rods adapted to slidingly engage rod holders attached to said chest support.

9. The chair of claim 1 including a front foot member attached to the lower ends of said pair of front legs of said seat subassembly, and a rear foot member attached to the lower ends of said rear legs of said seat subassembly.

10. The chair of claim 9 including first cable means attached at a first end to said front foot member and at a second end to said seat support means, said first cable being connected at a location intermediate said first and second ends to said rear foot member, to thereby limit movement of said front foot member in a direction away from said rear foot member.

11. The chair of claim 10 wherein said seat support means has a plurality of attachment points located at varying distances from said rear foot member for attaching said second end of said cable means to thereby permit adjustment of the distance between said front and rear foot members.

12. The chair of claim 9 including tensioning cable means attached at a first end to said cross brace extending between said pair of connector arms and at its second end to said front foot member.

13. The chair of claim 12 including a leg support cross brace extending between said pair of leg support means.

14. The chair of claim 13 including vertical cable means attached at its first end to said leg support cross brace and at its second end to said first cable means.

15. The chair of claim 1 including slots located in each of said second ends of said pair of connector arms and a pin extending from each of said support legs and through each of said slots to thereby allow said upper body support subassembly to be folded toward said seat subassembly for transport and storage of said chair, each of said slots having enlarged openings located at their front ends to receive said pins in locking engagement during use of said chair.

* * * * *